US007033178B2

(12) United States Patent
Wood et al.

(10) Patent No.: US 7,033,178 B2
(45) **Date of Patent: *Apr. 25, 2006**

(54) INTERACTIVE APPARATUS WITH INTERACTIVE DEVICE

(75) Inventors: Michael C. Wood, Orinda, CA (US); Jorge Gabriel Soto, Concord, CA (US)

(73) Assignee: LeapFrog Enterprises, Inc., Emeryville, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/819,482

(22) Filed: Apr. 6, 2004

(65) Prior Publication Data

US 2004/0191733 A1 Sep. 30, 2004

Related U.S. Application Data

(63) Continuation of application No. 10/198,483, filed on Jul. 17, 2002, now Pat. No. 6,761,611.

(60) Provisional application No. 60/308,937, filed on Jul. 30, 2001.

(51) Int. Cl.
*A63H 33/00* (2006.01)

(52) U.S. Cl. ..... 434/81; 446/175; 446/242; 446/484

(58) Field of Classification Search ..... 473/571; 443/242, 243, 265, 266, 484, 397, 409; 434/81, 434/206; 446/242, 243, 265, 266, 484, 397, 446/409, 175

See application file for complete search history.

(56) References Cited

U.S. PATENT DOCUMENTS

| | | | | |
|---|---|---|---|---|
| 640,792 | A * | 1/1900 | Munsell | 446/243 |
| 2,504,650 | A | 4/1950 | Chessrown | |
| 3,106,397 | A | 10/1963 | Lacey | |
| 4,077,631 | A * | 3/1978 | Tela, Sr. | 273/142 E |
| 4,274,639 | A * | 6/1981 | Flanders | 273/402 |
| 4,599,077 | A | 7/1986 | Vuillard | |
| 4,662,260 | A * | 5/1987 | Rumsey | 84/653 |
| 4,737,134 | A | 4/1988 | Rumsey | |
| 4,801,141 | A | 1/1989 | Rumsey | |
| 5,049,107 | A | 9/1991 | De Nittis | |
| 5,150,907 | A * | 9/1992 | Desmarais et al. | 273/240 |
| 5,221,225 | A | 6/1993 | Newbold et al. | |
| 5,260,512 | A | 11/1993 | Chomette et al. | |
| 5,288,069 | A * | 2/1994 | Matsumoto | 473/570 |
| 5,316,293 | A * | 5/1994 | Hamilton | 473/570 |
| 5,490,047 | A | 2/1996 | O'Rourke et al. | |

(Continued)

FOREIGN PATENT DOCUMENTS

GB 2214832 A 9/1989

OTHER PUBLICATIONS

Epinions.com "Reviews of Smart Bright Light Baby Ball", Jun. 6, 2001 (print date).

*Primary Examiner*—Jacob K. Ackun, Jr.
(74) *Attorney, Agent, or Firm*—Townsend and Townsend and Crew LLP

(57) ABSTRACT

An interactive apparatus is disclosed. In one embodiment, the apparatus includes a interactive ball includes (a) a plurality of indicia, (b) a processor and memory unit operatively coupled to the plurality of indicia, (c) an audio output unit operatively coupled to the processor and memory unit, (d) a first outer surface; and (e) a second outer surface that is recessed with respect to the first outer surface, wherein the plurality of indicia are present at the second outer surface.

16 Claims, 9 Drawing Sheets

U.S. PATENT DOCUMENTS 5,492,335 A 2/1996 Videnov
5,505,621 A 4/1996 Lamphiear
5,533,920 A 7/1996 Arad et al.
5,672,090 A 9/1997 Liu
5,810,685 A * 9/1998 Willner et al. ..... 473/571
6,016,910 A 1/2000 Rodearmel
6,068,534 A 5/2000 Strongin
6,083,076 A * 7/2000 Saint-Victor ..... 446/242
6,142,784 A * 11/2000 Wood ..... 434/201
6,215,978 B1 4/2001 Ruzic et al.
6,251,035 B1 * 6/2001 Fa ..... 473/570
6,491,516 B1 * 12/2002 Tal et al. ..... 431/253
6,603,709 B1 * 8/2003 Ochoa Loaiza ..... 368/23
6,695,670 B1 * 2/2004 Driscoll et al. ..... 446/242
6,761,611 B1 * 7/2004 Wood et al. ..... 446/175

* cited by examiner

| | FUNCTION | RECORDING | LEDS |
|---|---|---|---|
| 1 | Slide switch from Off to Low or High | ("Start-up" Tune) | All eight lights flash, two at a time (one each per side of ball), during playing of Tune |
| 2 | Slide switch from Low or High to Off | (hard off) | |
| 3 | After 15 seconds of inactivity | ("Shut-down" Tune) / [sleep mode] | All eight lights flash, two at a time (one each per side of ball), during playing of Tune |
| 4 | | | |
| 5 | LETTERS MODE | | |
| 6 | Slide mode switch to Letters Mode | Letter Names! | |
| 7 | Spin ball (in or out of base) | (Sings ABC's song) | All eight lights flash, two at a time (one each per side of ball), during playing of Tune |
| 8 | Press the letter A | A | LED pair nearest the letter pressed, flash during speech |
| 9 | Press the letter B | B | LED pair nearest the letter pressed, flash during speech |
| 10 | Press the letter C | C | LED pair nearest the letter pressed, flash during speech |
| 11 | Press the letter D | D | LED pair nearest the letter pressed, flash during speech |
| 12 | Press the letter E | E | LED pair nearest the letter pressed, flash during speech |
| 13 | Press the letter F | F | LED pair nearest the letter pressed, flash during speech |
| 14 | Press the letter G | G | LED pair nearest the letter pressed, flash during speech |
| 15 | Press the letter H | H | LED pair nearest the letter pressed, flash during speech |
| 16 | Press the letter I | I | LED pair nearest the letter pressed, flash during speech |
| 17 | Press the letter J | J | LED pair nearest the letter pressed, flash during speech |
| 18 | Press the letter K | K | LED pair nearest the letter pressed, flash during speech |
| 19 | Press the letter L | L | LED pair nearest the letter pressed, flash during speech |
| 20 | Press the letter M | M | LED pair nearest the letter pressed, flash during speech |
| 21 | Press the letter N | N | LED pair nearest the letter pressed, flash during speech |
| 22 | Press the letter O | O | LED pair nearest the letter pressed, flash during speech |

FIG. 5(a)

| | FUNCTION | RECORDING | LEDS |
|---|---|---|---|
| 23 | Press the letter P | P | LED pair nearest the letter pressed, flash during speech |
| 24 | Press the letter Q | Q | LED pair nearest the letter pressed, flash during speech |
| 25 | Press the letter R | R | LED pair nearest the letter pressed, flash during speech |
| 26 | Press the letter S | S | LED pair nearest the letter pressed, flash during speech |
| 27 | Press the letter T | T | LED pair nearest the letter pressed, flash during speech |
| 28 | Press the letter U | U | LED pair nearest the letter pressed, flash during speech |
| 29 | Press the letter V | V | LED pair nearest the letter pressed, flash during speech |
| 30 | Press the letter W | W | LED pair nearest the letter pressed, flash during speech |
| 31 | Press the letter X | X | LED pair nearest the letter pressed, flash during speech |
| 32 | Press the letter Y | Y | LED pair nearest the letter pressed, flash during speech |
| 33 | Press the letter Z | Z | LED pair nearest the letter pressed, flash during speech |
| 34 | | | |
| 35 | PHONICS MODE | | |
| 36 | Slide mode switch to Phonics Mode | Letter Sounds! | |
| 37 | Spin ball (in or out of base) | (Sings ABC's song) | All eight lights flash, two at a time (one each per side of ball), during playing of Tune |
| 38 | Press the letter A | Ah | LED pair nearest the letter pressed, flash during speech |
| 39 | Press the letter B | Buh | LED pair nearest the letter pressed, flash during speech |
| 40 | Press the letter C | Kuh | LED pair nearest the letter pressed, flash during speech |
| 40a | Press the letter C directly after pressing the letter F | (Interruption Tune) / Kuh | LED pair nearest the letter pressed, flash during speech |
| 40b | Press the letter C directly after pressing the letter S | (Interruption Tune) / Kuh | LED pair nearest the letter pressed, flash during speech |
| 40c | Press the letter C directly after pressing the letter U | (Interruption Tune) / Kuh | LED pair nearest the letter pressed, flash during speech |
| 41 | Press the letter D | Duh | LED pair nearest the letter pressed, flash during speech |
| 42 | Press the letter E | Eh | LED pair nearest the letter pressed, flash during speech |
| 43 | Press the letter F | Fff | LED pair nearest the letter pressed, flash during speech |
| 44 | Press the letter G | Guh | LED pair nearest the letter pressed, flash during speech |
| 45 | Press the letter H | Hhh | LED pair nearest the letter pressed, flash during speech |
| 46 | Press the letter I | Ih | LED pair nearest the letter pressed, flash during speech |
| 47 | Press the letter J | Juh | LED pair nearest the letter pressed, flash during speech |
| 48 | Press the letter K | Kuh | LED pair nearest the letter pressed, flash during speech |
| 48a | Press the letter K directly after pressing the letter F | (Interruption Tune) / Kuh | LED pair nearest the letter pressed, flash during speech |
| 48b | Press the letter K directly after pressing the letter S | (Interruption Tune) / Kuh | LED pair nearest the letter pressed, flash during speech |
| 48c | Press the letter K directly after pressing the letter U | (Interruption Tune) / Kuh | LED pair nearest the letter pressed, flash during speech |
| 49 | Press the letter L | Ul | LED pair nearest the letter pressed, flash during speech |
| 50 | Press the letter M | Mmm | LED pair nearest the letter pressed, flash during speech |

FIG. 5(b)

| | FUNCTION | RECORDING | LEDS |
|---|---|---|---|
| 51 | Press the letter N | Nnn | LED pair nearest the letter pressed, flash during speech |
| 52 | Press the letter O | Ah | LED pair nearest the letter pressed, flash during speech |
| 53 | Press the letter P | Puh | LED pair nearest the letter pressed, flash during speech |
| 53a | Press the letter P directly after pressing the letter W | (Interruption Tune) / Puh | LED pair nearest the letter pressed, flash during speech |
| 54 | Press the letter Q | Kwuh | LED pair nearest the letter pressed, flash during speech |
| 55 | Press the letter R | Er | LED pair nearest the letter pressed, flash during speech |
| 56 | Press the letter S | Sss | LED pair nearest the letter pressed, flash during speech |
| 56a | Press the letter S directly after pressing the letter A | (Interruption Tune) / Sss | LED pair nearest the letter pressed, flash during speech |
| 57 | Press the letter T | Tuh | LED pair nearest the letter pressed, flash during speech |
| 58 | Press the letter U | Uh | LED pair nearest the letter pressed, flash during speech |
| 59 | Press the letter V | Vuh | LED pair nearest the letter pressed, flash during speech |
| 60 | Press the letter W | Wuh | LED pair nearest the letter pressed, flash during speech |
| 61 | Press the letter X | Ks | LED pair nearest the letter pressed, flash during speech |
| 61a | Press the letter X directly after pressing the letter F | (Interruption Tune) / Ks | LED pair nearest the letter pressed, flash during speech |
| 61b | Press the letter X directly after pressing the letter S | (Interruption Tune) / Ks | LED pair nearest the letter pressed, flash during speech |
| 61c | Press the letter X directly after pressing the letter A | (Interruption Tune) / Ks | LED pair nearest the letter pressed, flash during speech |
| 62 | Press the letter Y | Yuh | LED pair nearest the letter pressed, flash during speech |
| 63 | Press the letter Z | Zih | LED pair nearest the letter pressed, flash during speech |
| 64 | | | |
| 65 | MUSIC MODE | | |
| 66 | Slide mode switch to Music Mode | Music! | |
| 67 | Spin ball (in or out of base) | (Plays Instrumental Music Song 1 of 3) (Should alternate between these three songs at random: no repeat) | All eight lights flash, two at a time (one each per side of ball), during playing of Tune |
| 68 | Press the letter A | (Plays Song A) | All eight lights flash, two at a time (one each per side of ball), during playing of Tune |
| 69 | Press the letter B | (Plays Song B) | All eight lights flash, two at a time (one each per side of ball), during playing of Tune |
| 70 | Press the letter C | (Plays Song C) | All eight lights flash, two at a time (one each per side of ball), during playing of Tune |
| 71 | Press the letter D | (Plays Song D) | All eight lights flash, two at a time (one each per side of ball), during playing of Tune |
| 72 | Press the letter E | (Plays Song E) | All eight lights flash, two at a time (one each per side of ball), during playing of Tune |
| 73 | Press the letter F | (Plays Song F) | All eight lights flash, two at a time (one each per side of ball), during playing of Tune |
| 74 | Press the letter G | (Plays Song G) | All eight lights flash, two at a time (one each per side of ball), during playing of Tune |
| 75 | Press the letter H | (Plays Song H) | All eight lights flash, two at a time (one each per side of ball), during playing of Tune |

FIG. 5(c)

| | FUNCTION | RECORDING | LEDS |
|---|---|---|---|
| 76 | Press the letter I | (Plays Song I) | All eight lights flash, two at a time (one each per side of ball), during playing of Tune |
| 77 | Press the letter J | (Plays Song J) | All eight lights flash, two at a time (one each per side of ball), during playing of Tune |
| 78 | Press the letter K | (Plays Song K) | All eight lights flash, two at a time (one each per side of ball), during playing of Tune |
| 79 | Press the letter L | (Plays Song L) | All eight lights flash, two at a time (one each per side of ball), during playing of Tune |
| 80 | Press the letter M | (Plays Song M) | All eight lights flash, two at a time (one each per side of ball), during playing of Tune |
| 81 | Press the letter N | (Plays Song N) | All eight lights flash, two at a time (one each per side of ball), during playing of Tune |
| 82 | Press the letter O | (Plays Song O) | All eight lights flash, two at a time (one each per side of ball), during playing of Tune |
| 83 | Press the letter P | (Plays Song P) | All eight lights flash, two at a time (one each per side of ball), during playing of Tune |
| 84 | Press the letter Q | (Plays Song Q) | All eight lights flash, two at a time (one each per side of ball), during playing of Tune |
| 85 | Press the letter R | (Plays Song R) | All eight lights flash, two at a time (one each per side of ball), during playing of Tune |
| 86 | Press the letter S | (Plays Song S) | All eight lights flash, two at a time (one each per side of ball), during playing of Tune |
| 87 | Press the letter T | (Plays Song T) | All eight lights flash, two at a time (one each per side of ball), during playing of Tune |
| 88 | Press the letter U | (Plays Song U) | All eight lights flash, two at a time (one each per side of ball), during playing of Tune |
| 89 | Press the letter V | (Plays Song V) | All eight lights flash, two at a time (one each per side of ball), during playing of Tune |
| 90 | Press the letter W | (Plays Song W) | All eight lights flash, two at a time (one each per side of ball), during playing of Tune |
| 91 | Press the letter X | (Plays Song X) | All eight lights flash, two at a time (one each per side of ball), during playing of Tune |
| 92 | Press the letter Y | (Plays Song Y) | All eight lights flash, two at a time (one each per side of ball), during playing of Tune |
| 93 | Press the letter Z | (Plays Song Z) | All eight lights flash, two at a time (one each per side of ball), during playing of Tune |

FIG. 5(d)

INTERACTIVE APPARATUS WITH INTERACTIVE DEVICE

CROSS REFERENCE TO RELATED APPLICATIONS

This application is a continuation application of U.S. patent application Ser. No. 10/198,483, filed Jul. 17, 2002 and issued as U.S. Pat. No. 6,761,611, which claims priority from U.S. Provisional Patent Application No. 60/308,937 filed Jul. 30, 2001, all of which is hereby incorporated in its entirety by reference for all purposes.

BACKGROUND OF THE INVENTION

1. Field of the Invention

The present invention relates, in general, to an interactive apparatus and an interactive ball.

2. Description of the Related Art

Conventional learning apparatuses (e.g., educational toys) for young children are typically limited with respect to the breadth of curriculum that they teach. A conventional learning apparatus often strives to teach only one thing, such as cause-and-effect, musical awareness, indicia identity or phonics. In other words, the conventional learning apparatus may be limited to a single operating mode and, therefore, a single curriculum. Conventional learning apparatuses may also be focused solely on the teaching of a predetermined curriculum and, therefore, fail to adequately stimulate, engage and entertain a young child (i.e., children six months of age and older). This drawback can be especially pronounced when a young child is an infant with limited motor skills.

Still needed in the field, therefore, is a multi-curriculum learning apparatus. The apparatus would desirably improve, for example, a user's motor skills, cause-and-effect recognition skills, musical awareness, ability to identify indicia and understand phonics, etc. In addition, the learning apparatus would desirably be entertaining and engaging.

SUMMARY OF THE INVENTION

One embodiment of the invention is directed to an interactive ball comprising: (a) a plurality of indicia; (b) a processor and memory unit operatively coupled to the plurality of indicia; (c) an audio output unit operatively coupled to the processor and memory unit; (d) a first outer surface; and (e) a second outer surface that is recessed with respect to the first outer surface, wherein the plurality of indicia are present at the second outer surface.

Another embodiment of the invention is directed to an interactive ball including (a) a motion sensor unit; (b) a processor and memory unit operatively coupled to each of the plurality of indicia and to the motion sensor unit; and (c) an audio output unit operatively coupled to the processor and memory unit, wherein when the ball is undergoing a revolving motion, the ball plays a song, and wherein when the playing of the song stops when the ball stops revolving.

Other embodiments of the invention are directed to interactive apparatuses including interactive balls. For example, in one embodiment, the interactive apparatus comprises: a holder comprising a pair of arms; a ball comprising a plurality of indicia disposed around an equatorial band around the ball, wherein the pair of arms hold the ball so that the plurality of indicia are displayed to the user.

These and other embodiments of the invention are described in further detail below. A better understanding of the features and advantages of the present invention will be obtained by reference to the following detailed description that sets forth illustrative embodiments, in which the principles of the invention are utilized, and the accompanying drawings.

BRIEF DESCRIPTION OF THE DRAWINGS

FIGS. 5(*a*)–5(*d*) are tabulations of the logical relationships between indicia activation (e.g., pressing of an indicia) and interactive learning apparatus response of an exemplary interactive learning apparatus according to an embodiment of the invention

DETAILED DESCRIPTION

Figure 1:
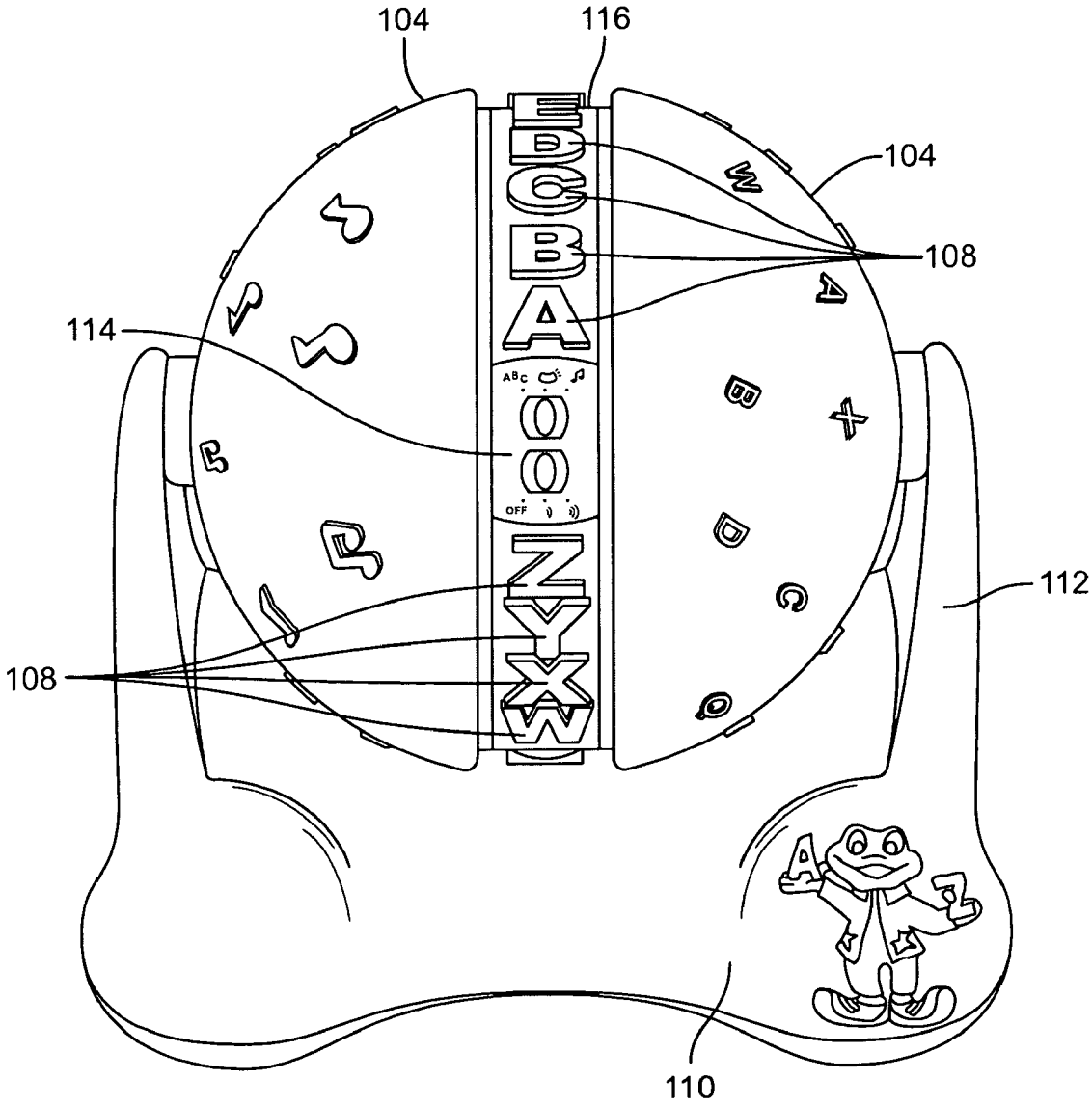
FIG. 1 is a perspective view of an interactive learning apparatus according to one exemplary embodiment of the present invention.

The interactive learning apparatuses and balls in accordance with embodiments of the invention are suitable for improving motor skills, cause-and-effect recognition, musical awareness, indicia (e.g., letters) identification skills, and phonics skills in a user. The interactive learning apparatuses and balls can be characterized as educational toys. These educational toys not only provide learning experiences, but also provide entertainment value.

An interactive learning apparatus according to one exemplary embodiment of the present invention includes a ball and a plurality of indicia (e.g., letters in the form of buttons or other alpha-numeric indicia) disposed thereon. The interactive learning apparatus also includes a motion sensor unit, a processor and memory unit and an audio output unit. The motion sensor unit is disposed within the ball. The processor and memory unit is cooperatively coupled to each of the plurality of indicia and to the motion sensor unit, while the audio output unit is cooperatively coupled to the processor and memory unit.

In some embodiments, the motion sensor unit, the processor and memory unit and the audio output unit are configured such that a song is played while the ball is revolving. Suitable computer code can be included in memory so that the playing of the song is halted when the ball stops revolving. The combination of song and the ball, which can be set into revolving motion (i.e., set spinning or rolling), provides age-appropriate stimuli for young children. Such a stimuli engages and entertains young children (i.e., six months of age and older) while simultaneously teaches motor-skills and musical awareness.

The memory can include a plurality of preprogrammed modes designed to teach different curricula in an engaging and entertaining manner. For example, the ball according to one exemplary embodiment of the invention can teach young children the identity (i.e., name) and phonetic pronunciation of indicia (e.g., the 26 letters of the alphabet) using two different operating modes. In one operating mode, referred to as "letters mode," the ball audibly identifies each of the plurality of indicia as the young child presses the indicia. In another operating mode, referred to as "phonics mode," the ball phonetically pronounces an indicium when a user presses it.

In yet another operating mode, referred to as "music mode," the ball can teach young children musical awareness. The interactive learning apparatus accomplishes this by playing a unique song (e.g., an instrumental song) associated with each of the plurality of indicia when an indicium is pressed. For example, in the circumstance where the plurality of indicia are the twenty-six letters of the alphabet, the interactive learning apparatus would play a different, and therefore unique, song when each letter is pressed.

The interactive learning apparatuses and balls can teach young children, including infants, motor skills by engaging their attention with a song (e.g., a soothing instrumental song), when the ball is rolled or spun. Cause-and-effect is also taught since the song plays when the ball is rolled or spun (i.e., is undergoing revolving motion), but stops playing when the revolving motion of the ball ceases. This aspect of the interactive learning apparatus can be functional in any of the three aforementioned operating modes. In addition, the interactive learning apparatus can also entertain, stimulate and engage young children with lights that can illuminate in the aforementioned three operating modes.

FIG. 1 shows an interactive learning apparatus 100 including a ball 102 with a first outer surface 104 and a second outer surface 106. Second outer surface 106 is recessed below first outer surface 104. The ball 102 is powered using batteries (not shown) stored within the ball 102. In some embodiments, the ball 102 may be designed so that it automatically shuts down if the user does not interact with it for a predetermined period of time. Although the ball can have any suitable dimensions, an exemplary ball can have a diameter of 6 inches. The ball may also be made of any suitable material. For example, the outer surfaces of the ball may be covered with a soft, tactile material (e.g., Krayton™) for ease of gripping, impact resistance and impact protection for both ball 102 and a user (e.g., a young child six months of age or older).

The ball 102 may include a housing. In the embodiment shown in FIG. 1, the housing may include two separate hemispheres of plastic material. The first outer surface 104 of the ball 102 may be on the separate hemispheres. These hemispheres may be coupled to another plastic body that includes the second outer surface 106. The hemispheres may be screwed onto the plastic body or may be coupled through some other suitable mechanism.

The ball 102 also includes a plurality of indicia 108 in the form of raised buttons disposed at second outer surface 106. In the illustrated exemplary embodiment of FIG. 1, the plurality of indicia 108 is composed of the twenty-six letters of the alphabet. Underneath each of the depressible buttons lies a switch such as a Mylar™ switch. The plurality of indicia 108 are recessed below first outer surface 104 so that they will not be depressed when a young child rolls ball 102 across a surface (e.g., the surface of a floor). Advantageously, the ball 102 can have a playful function that is independent of the electronics in the ball. This makes the ball 102 independently inviting to a user and the user will be attracted to interact with the ball 102 regardless of the electronic function provided by the ball. The twenty-six letters are disposed on second outer surface 106 in the form of an equatorial-band that encircles ball 102. Although letters are described as exemplary indicia, it is understood that embodiments of the invention are not limited to the use of letters. For example, the indicia may include numbers, symbols, etc.

Figure 4:
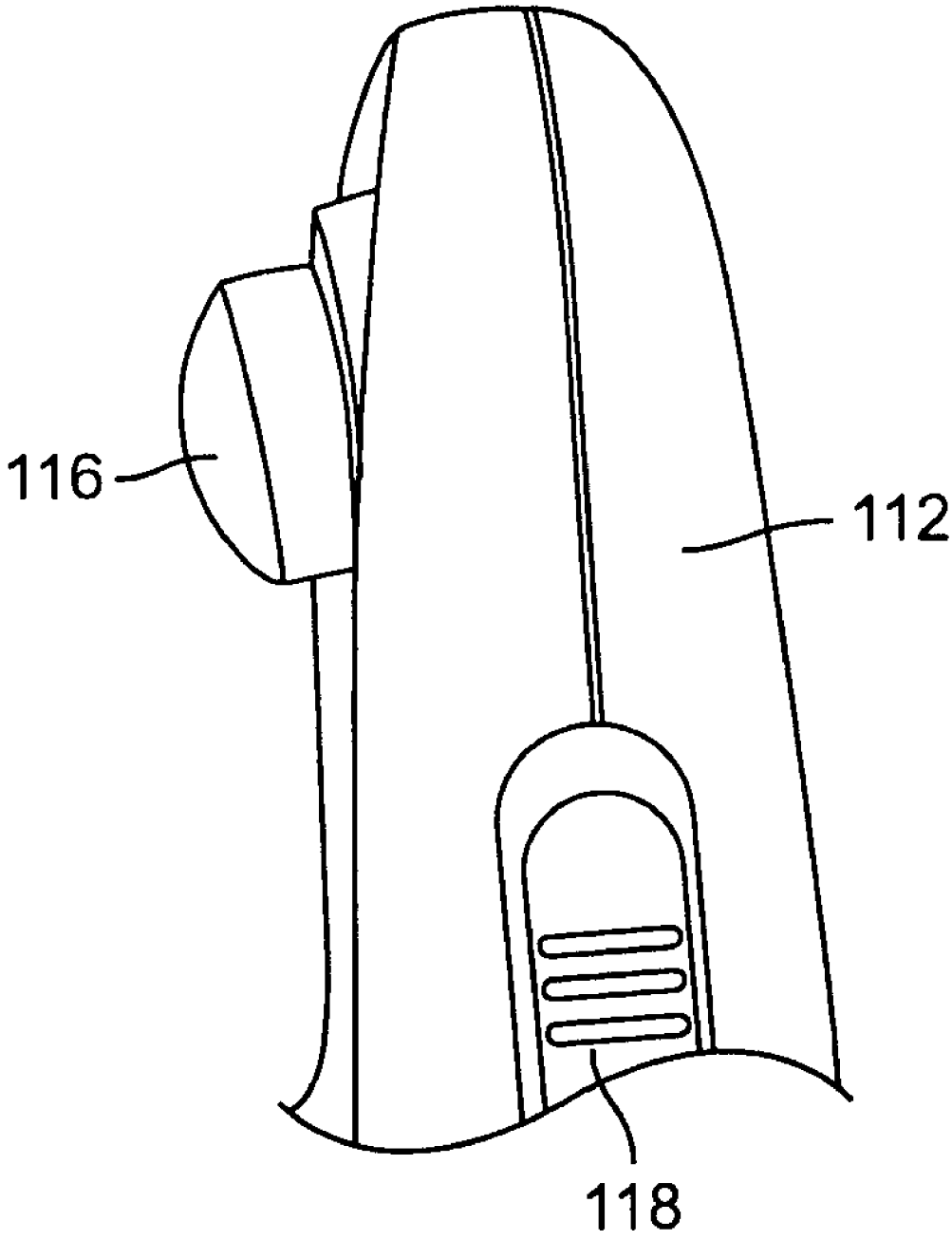
FIG. 4 is a perspective view of an arm, which includes a locking/release mechanism, of an interactive learning apparatus according to an alternative exemplary embodiment of the present invention.

Also included in interactive learning apparatus 100 is a rigid holder 110 designed to rotatably support the ball 102. Two arms 112 hold the ball 102. If desired, a locking/release mechanism can be included in one of the arms 112 to prevent accidental detachment of the ball 102 from holder 110. Such a locking/release mechanism can included, for example, a retractable knob (such as retractable knob 116 shown in FIG. 4) that holds ball 102 in place when in a non-retracted position and releases ball 102 for detachment from holder 110 when in a retracted position. The retractable knob can be moved between the retracted and non-retracted positions by operation of, for example, an associated button (such as button 118 shown in FIG. 4) and/or a lock. Although the holder can have any suitable size, an exemplary holder can be about 7.5 inches wide, 6 inches deep, and 4 inches tall.

Holder 110 allows a young child to spin ball 102 while the holder 110 is holding it. The young child can spin the ball in a single direction. For example, with reference to FIG. 1, a child can touch the ball and spin the ball so that the plurality of indicia 108 spins in a vertical line. This allows different indicium within the plurality of indicia to be displayed to the child at the child's desire. For instance, the child may view one indicium such as the letter A and depress it causing the ball 102 to say "A, A says A". Then, the child may rotate the ball 102 in a forward or backward direction so that another letter such as the letter K is displayed to the child. The child can then interact with the letter K.

The ball 102 is detachable from holder 110 by operation of a locking/release mechanism included in an arm of holder 110. When ball 102 is detached from holder 110, ball 102 is free to roll across a surface and be otherwise handled and manipulated by a young child. Advantageously, the ball 102 can function independently of the holder 110 and the young child can play with the ball 102 as the child would play with any other type of ball. When the ball 102 is in the holder, it can be used to teach and engage the child like other types of electronic learning toys. Accordingly, embodiments of the invention can be readily changed and provide for multiple different modes of entertainment and education.

The ball 102 also includes an input unit 114 disposed on second outer surface 106. In the illustrated exemplary embodiment of FIG. 1, input unit 114 includes a slidable knob. However, one skilled in the art will recognize that input unit 114 can take other suitable forms including, but are not limited to, a rotatable knob, a button, a lever or a switch. Input unit 114 is configured to enable a user (e.g., a young child or a young child's parent) to turn the ball 102 on and off, to control the volume and to select an operating mode.

The ball 102 can also include a plurality of lights (not shown in FIG. 1). In an exemplary embodiment, the plurality of lights can comprise, for example, light emitting diodes (LEDs) disposed along the edges of second outer surface 106 or "grain of wheat lights" configured to transmit light to first outer surface 104 and/or second outer surface 106. The plurality of lights can be activated in response to the rotation of the ball 102 and/or upon the selective activation of the plurality of indicia 108 by a user. For example, in one embodiment of the invention, a plurality of lights may be associated with a plurality of indicia. When a particular indicium is selected by a user, a light near to the indicium may illuminate. The other lights remain un-illuminated. In another example, the lights may be spaced apart from each other about an equator of the ball 102. When the ball is rolled, the lights may illuminate in sequence or at random. When rolling stops, the illumination of the lights can terminate. The lights may be placed, for example, 45 degrees apart from each other so that it appears that the equatorial band of the ball 102 illuminates. The plurality of lights, therefore, engages and entertains young children and can reinforce learning.

Ball 102, plurality of indicia 108 and holder 110 can each be distinctively colored and molded with sculpted textural detail that serve to further engage the attention of a user. For example, first outer surface 104 can be molded with a various designs including musical notes, letters, and animated characters.

Figure 2:
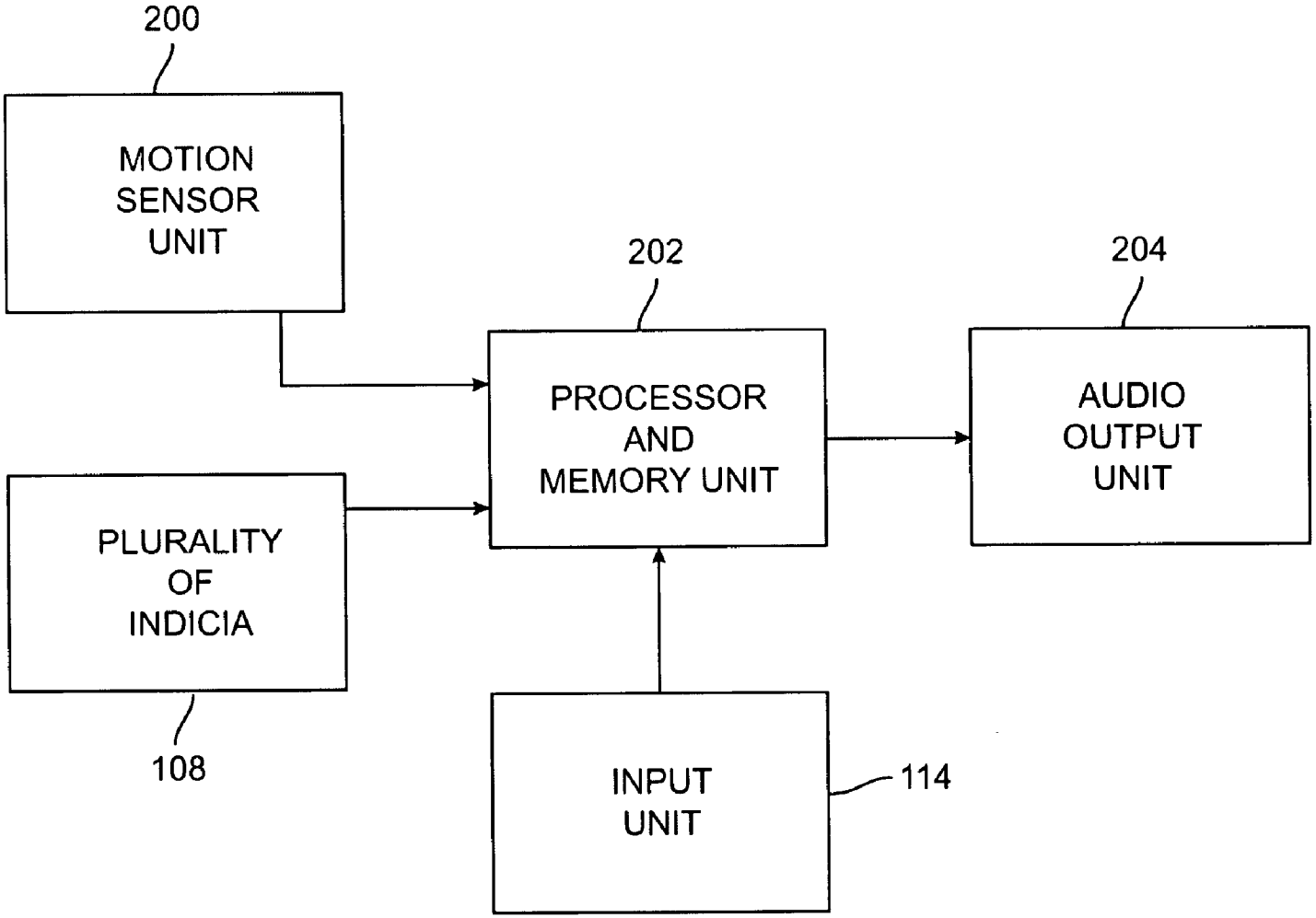
FIG. 2 is a block diagram of units employed in one exemplary embodiment of the present invention.

As illustrated in FIG. 2, in some embodiments of the invention, the interactive learning apparatus 100 also includes a motion sensor unit 200, a processor and memory unit 202 and an audio output unit 204, as illustrated in FIG. 2. Motion sensor unit 200 can be any suitable motion sensor unit known to one skilled in the art. An example of a suitable motion sensor can include one or more ball-in-cage type motion sensors. The audio output unit 204 can include a speech synthesizer (e.g. a speech synthesizer chip) and a speaker.

Processor and memory unit 202 is operatively connected to motion sensor unit 200, audio output unit 204, plurality of indicia 108 and input unit 114. Processor and memory unit 202 can be any suitable processor and memory unit, known to one skilled in the art, for facilitating operation of interactive learning apparatus 100. An exemplary processor and memory unit 202 includes a combination of a microprocessor (e.g., an application specific integrated circuit [ASIC] microprocessor) and a random access memory (RAM), read only memory (ROM) or erasable programmable memory (EPROM) integrated circuit. Such a processor and memory unit 202 can store information required to create approximately 60 seconds of audible speech. The processor and memory unit 202 may be two separate and distinct chips (e.g., a microprocessor chip, and a ROM or EPROM chip). Alternatively, the processor and memory unit 202 may be housed in a single electronic package.

Motion sensor unit 200, processor and memory unit 202 and audio output unit 204 can be configured such that a song (e.g., the "ABCs" song, an original tune or a public domain song) is played while the ball is undergoing revolving motion. They can also be configured such that the song stops playing at a song halt point, when the ball ceases to undergo revolving motion. For example, each song can include song halt points such that the song is divided into twelve segments. When the ball ceases to undergo revolving motion, the song can be stopped in the course of the song upon reaching the next song halt point. If the ball again undergoes revolving motion within a predetermined time period (e.g., 5 seconds), the song can begin playing from that song halt point. In some embodiments, the motion sensor unit 200 may include a rotational sensor that can provide a signal if the ball is rotating or and a different signal if it is not. Such rotational sensors are known to those of ordinary skill in the art and need not be described in detail here.

Processor and memory unit 202 can also be configured to implement a plurality of operating modes designed to teach different curricula in an engaging and entertaining manner. There are three exemplary operating modes, referred to as "letters mode," "phonics mode" and "music mode." In the "letters mode," the interactive learning apparatus audibly informs the child of the nature of learning by calling out the phrase "Letter Names!" when input device 114 is employed to select the letters mode. Thereafter, the interactive learning apparatus identifies each of the plurality of indicia (i.e., each of the 26 letters of the alphabet) as the indicia are pressed by the young child. For example, if the child presses an "A" shaped indicia, the interactive learning apparatus audibly informs the child that the indicia is "A."

In the "phonics mode," the interactive learning apparatus phonetically pronounces each of the plurality of indicia as the indicia is pressed. For example, if the child presses a "G" shaped indicia, the interactive learning apparatus audibly pronounces the phonetic sound "Guh" that is associated with the letter "G."

In the "music mode," the interactive learning apparatus teaches young children musical awareness. The interactive learning apparatus accomplishes this by playing a unique song associated with each of the plurality of indicia when an indicium is pressed. For example, in the circumstance where the plurality of indicia are the twenty-six letters of the alphabet, the interactive learning apparatus plays a different, and therefore unique, song when each letter is pressed. In one exemplary embodiment, the unique songs are frequently related to the indicia in some manner. For example, the unique song can be the well known song "Billy Boy" for the letter "B" indicia, while the unique song can be the well known song "Clementine" for the letter "C" indicia.

Figure 3A:
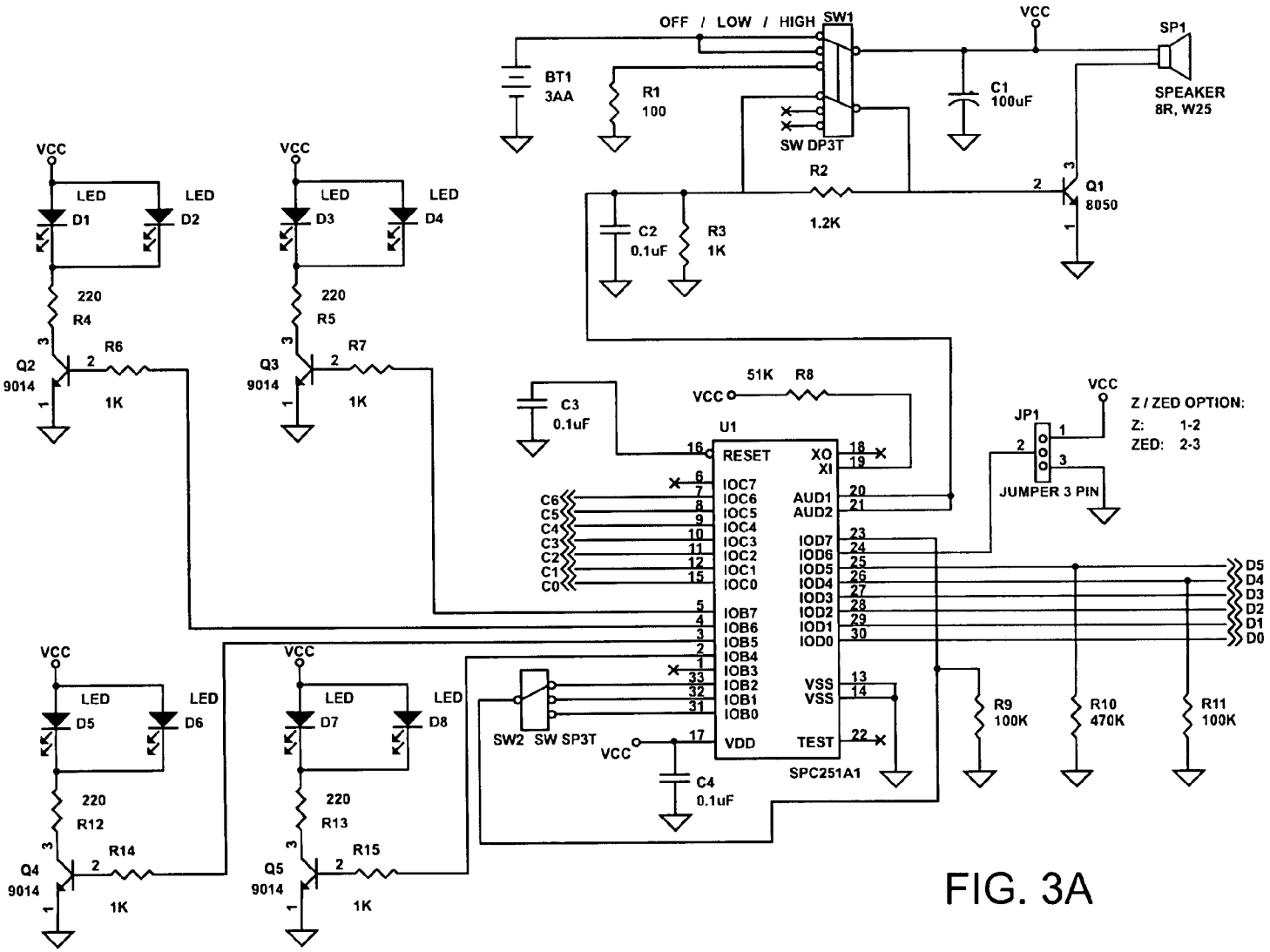
FIGS. 3A, 3B, and 3C are electrical schematic diagrams of an exemplary circuit, which implements functions (e.g., operating modes), in accordance with the present invention.
Figure 3B:
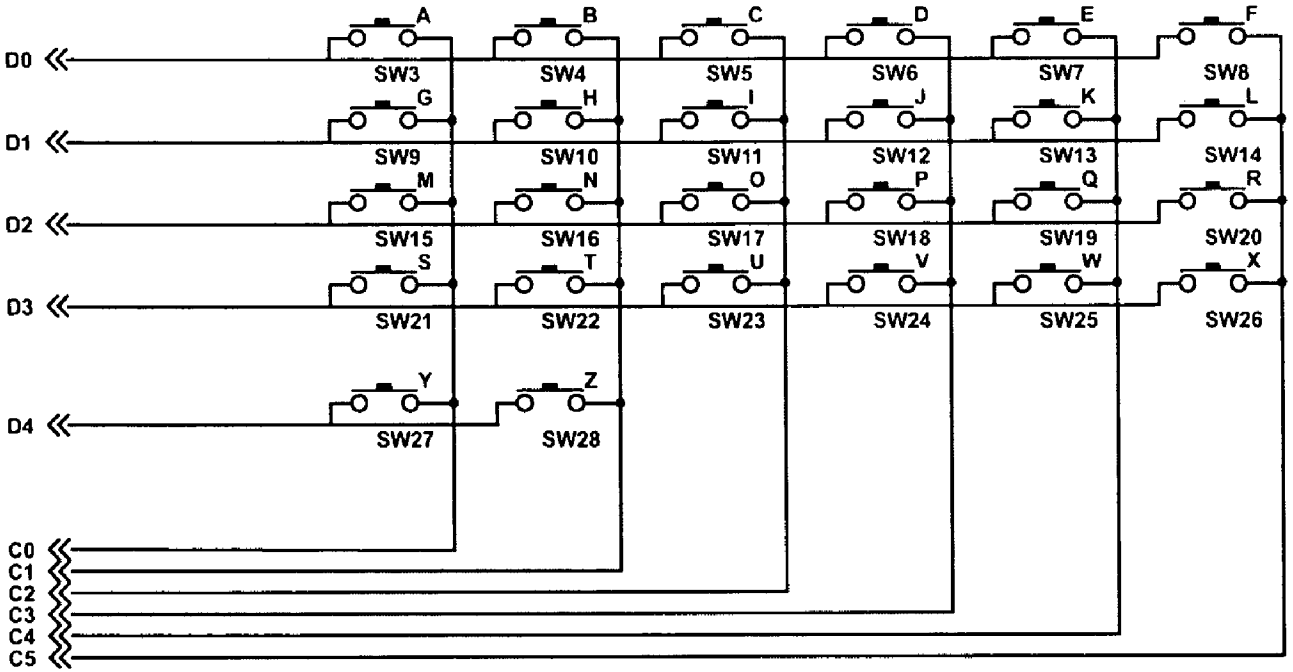
Figure 3C:
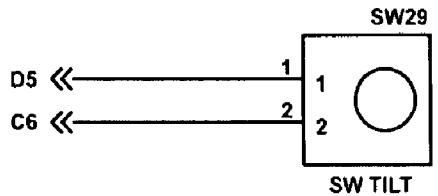

FIGS. 3A–3B are electrical schematic diagrams of an exemplary circuit which implements functions (e.g., operating modes) of the present invention. Those ordinarily skilled in the art of electronic toys have knowledge, however, of a variety of microprocessors, logic circuits and other electronic components that can be utilized to implement the functions of interactive learning apparatuses and balls according to embodiments of the present invention.

FIGS. 5(*a*)–5(*d*) are detailed tabulations of functions and the logical relationships between indicia activation and the response for an exemplary interactive learning apparatus according to an embodiment of the present invention. Included in the Figures are the responses for each of the three aforementioned exemplary operational modes: "letters mode," "phonics mode" and "music mode."

The interactive learning apparatus according to the present invention can optionally include a slot (not shown) for a transferable information storage medium that is operatively coupled to the processor and memory unit. The slot can be cooperatively structured to receive the transferable storage medium in a removable manner. Any suitable transferable storage medium can be employed in the interactive learning apparatus including, but not limited to, a data cartridge (e.g., a flash memory cartridge), a disk, a tape or a memory stick. The transferable information storage medium can be used to provide code for new operating modes or new audio data (e.g., new songs) to the interactive learning apparatus.

The interactive learning apparatus can also form part of a system that provides the interactive ball with new content if desired. For example, in some embodiments, a linker device can be used to transfer data (e.g., new audio data or code for new operating modes) between the ball and a computer (e.g., an Internet-enabled personal computer or server computer). The linker device can be any suitable linker device known to one skilled in the art, such as a wireless transceiver (e.g., a radio frequency [RF] transceiver or an infra-red [IR] transceiver) or a data port (e.g., a Universal Serial Bus [USB] data port). Such a data port enables a user to transfer data to, and from, the interactive learning apparatus through a physical connection (e.g., a data cable) among the interactive learning apparatus and a client PC or the Internet. The inclusion of a linker device in the interactive learning apparatus results in an Internet-enabled interactive learning apparatus.

It should be understood that various alternatives to the embodiments of the invention described herein may be employed in practicing the invention. It is intended that the following claims define the scope of the invention and that structures and methods within the scope of these claims and their equivalents be covered thereby.

What is claimed is:

1. An interactive apparatus comprising:

a rigid holder comprising a pair of arms;

an interactive device comprising (a) a plurality of letters or numbers disposed around an equatorial band around the device;

(b) a motion sensor unit, (c) a processor and memory unit operatively coupled to the motion sensor unit, and (d) an audio output unit operatively coupled to the processor and memory unit, wherein the interactive device is mounted on a portion of the holder so that the interactive device is able to undergo a revolving motion in relation to the portion of the holder upon which it is mounted, and wherein the revolving motion causes the interactive device to play a song, and wherein stopping of the revolving motion causes the playing of the song to stop, and wherein the pair of arms hold the interactive device so that the plurality of letters or numbers is displayed to the user.

2. The interactive apparatus of claim 1, wherein the device is capable being spun by a user in a uniaxial direction while the device is held by the holder.

3. A device including a rigid holder; and an interactive device mounted on a portion of the holder so that the interactive device is able to undergo a revolving motion in relation to the portion of the holder upon which it is mounted, wherein the interactive device comprises (a) a motion sensor unit, (b) a processor and memory unit operatively coupled to the motion sensor unit, and (c) an audio output unit operatively coupled to the processor and memory unit, wherein the revolving motion causes the interactive device to play a song, and wherein stopping of the revolving motion causes the playing of the song to stop.

4. The device of claim 3, wherein the song stops at a song halt point, and wherein the song begins playing from the song halt point after the revolving motion re-starts.

5. The device of claim 3 further comprising a plurality of indicia.

6. The device of claim 3 further comprising a plurality of indicia, wherein the plurality of indicia, the processor and memory unit and the audio output unit are configured such that when an indicium of one of the plurality of indicia is pressed, the depressed indicium is phonetically pronounced.

7. The device of claim 3 further comprising a plurality of indicia, wherein each indicium in the plurality of indicia corresponds to a different song.

8. The device of claim 3 further comprising:

a plurality of lights disposed on the interactive device.

9. The device of claim 3, wherein the interactive device includes a first outer surface and a second outer surface, the second outer surface recessed below the first outer surface, and wherein the plurality of indicia is disposed at the second outer surface are below the first outer surface.

10. The device of claim 3, wherein the plurality of indicia is in the form of buttons disposed below the first outer surface.

11. The device of claim 3, wherein the second outer surface includes an equatorial band.

12. The device of claim 3, wherein the plurality of indicia is alphanumeric indicia.

13. The device of claim 3, wherein the plurality of indicia includes the 26 letters of the alphabet.

14. The device of claim 3, wherein the audio output unit includes a sound synthesizer and speaker.

15. The device of claim 3, wherein the motion sensor unit includes at least one ball-in-cage motion sensor.

16. The device of claim 3, wherein an outer surface of the device is formed at least partially of a soft material.

* * * * *